United States Patent [19]

Brendgord et al.

[11] Patent Number: 4,872,656

[45] Date of Patent: Oct. 10, 1989

[54] ORTHOPEDIC TABLE WITH MOVABLE UPPER BODY AND SACRUM SUPPORTS

[75] Inventors: Thomas Brendgord; Ward L. Sanders; Dennis C. Coon, all of Erie, Pa.

[73] Assignee: American Sterilizer Company, Erie, Pa.

[21] Appl. No.: 119,311

[22] Filed: Nov. 9, 1987

Related U.S. Application Data

[63] Continuation of Ser. No. 587,926, Mar. 9, 1984, abandoned, which is a continuation of Ser. No. 332,656, Dec. 21, 1981, abandoned.

[51] Int. Cl.[4] ..... A61G 13/00

[52] U.S. Cl. ..... 269/322

[58] Field of Search ..... 269/322-328, 269/164; 128/70-73, 83-84; 51/81 B; 108/137, 143, 102

[56] References Cited

U.S. PATENT DOCUMENTS

| | | | |
|---|---|---|---|
| 2,198,871 | 4/1940 | Haboush | 128/84 R |
| 2,495,438 | 1/1950 | Bentley et al. | 269/70 |
| 2,897,029 | 7/1959 | Maisel . | |
| 2,926,977 | 3/1960 | Ragon | 269/328 |
| 3,420,229 | 1/1969 | Miller . | |
| 3,509,876 | 5/1970 | Pilz | 269/328 |
| 3,541,617 | 11/1970 | Clanan | 5/81 B |
| 3,654,920 | 4/1972 | Staib | 128/71 |
| 3,745,996 | 7/1973 | Rush | 269/328 |
| 3,845,946 | 11/1974 | Warden et al. | 269/323 |
| 4,039,799 | 8/1977 | Stumpf | 269/296 |
| 4,243,025 | 1/1981 | Jones | 269/328 |
| 4,259,756 | 4/1981 | Pace | 5/81 B |

FOREIGN PATENT DOCUMENTS

| | | |
|---|---|---|
| 452994 | 9/1936 | United Kingdom . |
| 614525 | 12/1948 | United Kingdom . |
| 674009 | 6/1952 | United Kingdom . |
| 691349 | 5/1953 | United Kingdom . |
| 772032 | 4/1957 | United Kingdom . |
| 1014630 | 12/1965 | United Kingdom . |
| 1052559 | 12/1966 | United Kingdom . |
| 1240782 | 7/1971 | United Kingdom . |

OTHER PUBLICATIONS

Tables by Tower brochure, 1949.

*Primary Examiner*—Robert C. Watson
*Attorney, Agent, or Firm*—Kirkpatrick & Lockhart

[57] ABSTRACT

An orthopedic table for supporting a patient in a desired position includes a support for the upper body of the patient and a support for the sacrum of the patient that move together transversely of the longitudinal axis of the table. The table permits positioning or repositioning of a patient on the table without causing the patient to experience undue physical trauma. The table affords convenient access by a surgeon to all parts of the patient's body. The table also permits improved examination of the patient's body with image-amplification equipment.

2 Claims, 4 Drawing Sheets

ORTHOPEDIC TABLE WITH MOVABLE UPPER BODY AND SACRUM SUPPORTS

CROSS REFERENCE TO RELATED APPLICATIONS

This is a continuation of co-pending application Ser. No. 587,926, filed on Mar. 9, 1984, now abandoned, which is a continuation of U.S. application Ser. No. 332,656, filed Dec. 21, 1981, now abandoned.

BACKGROUND OF THE INVENTION

1. Field of the Invention

The present invention relates to orthopedic tables and, more particularly, to an orthopedic table having movable upper body and sacrum supports.

2. Description of the Prior Art

Performance of modern orthopedic surgical procedures requires a support, or table, for the patient on whom the procedures are to be performed that satisfies several needs. The table must permit hospital personnel to transfer a patient from a litter to the table in a manner that requires application to the patient's body of as little physical stress as possible. The table should facilitate quick, convenient and precise positioning of the patient's body on the table. The table must permit hospital personnel to reposition the patient's body relative to the table with application to the patient's body of as little physical stress as possible. The table must provide unrestricted access by the orthopedic surgeon to the parts of the patient's body on which the surgical procedures are being performed. The table must permit positioning of image-amplification apparatus proximate all parts of the patient's body to permit examination of the parts of the patient's body on which the surgeon will perform surgical procedures, regardless of the type of procedure to be performed.

Conventional orthopedic tables include a support for the upper body of the patient, a base for supporting the upper body support a distance from the floor and abductor bars extending from the base for supporting and positioning the patient's legs. The abductor bars are usually mounted to the base for pivotal movement and include foot supports which are clamped to the bars. The foot supports can be moved along the abductor bars to accommodate patients of different sizes. The upper body support of a conventional orthopedic table is fixed to the base and cannot be moved relative to it. Further, the base of a conventional orthopedic table commonly includes a housing beneath the upper body support which contains control apparatus for tilting the upper body support, or portions of it, to facilitate performance of certain orthopedic surgical procedures.

The fixed position of the upper body support relative to the control housing and the portion of the table base which contacts the floor and the proximity of the housing to the upper body support cause several problems. Because image-amplification equipment must be placed near—usually both above and below—the part of the body to be examined, and because the control housing and base of conventional tables prevents such equipment from being positioned in a number of areas beneath the upper body support, the areas of the patients' body which can be examined with image-amplification apparatus is limited. Further, the control housing and base often prevent the orthopedic surgeon from assuming the position relative to the patient's body that is most favorable for performing a particular surgical procedure. Often, the control housing and base prevent personnel from positioning a litter bearing a patient adjacent the upper body support, thus forcing hospital personnel to manually transport the patient through a distance and risk causing the patient's body to experience physical trauma. Moreover, the fixed position, relative to the upper body support, of the ends of the abductor bars that are secured to the base ensures that the upper body support or abductor bars, depending on which surgical procedure is being performed, will hamper the orthopedic surgeon during his performance of the procedure. Also, since the position of the abductor bars relative to the upper body support cannot be altered, repositioning of the patient relative to the abductor bars for bilateral procedures must be accomplished by physically moving the patient on the the upper body support, thereby creating the possibility that the patient's body will experience physical trauma.

Accordingly, there exists a need for an orthopedic table that provides better access to areas of a patient's body upon which orthopedic surgical procedures are being performed than is provided by conventional orthopedic tables. Further, there exists a need for an orthopedic table that minimizes the risk of causing a patient's body to experience physical trauma when the patient is transferred from a litter to the table and as the surgical procedures are being performed.

SUMMARY OF THE INVENTION

The present invention provides an improved orthopedic table for supporting a patient in a desired position. The table has a longitudinal axis and includes a base bisected by a vertical plane passing through the longitudinal axis. A first table top, adapted to support the upper body of the patient, is mounted on the base and has a first position wherein the longitudinal axis of the first table top falls in the aforementioned vertical plane. A second table top, adapted to support the sacrum of the patient, is mounted adjacent the first table top and has a first position wherein the longitudinal axis of the second table top falls in the aforementioned vertical plane. A traction device mounting assembly extends from the base and is mounted thereto. The improvement of the present invention comprises the first and second table tops being movable in unitary fashion transversely of the longitudinal axis of the table to selected second positions. In the preferred embodiment of the present invention, the second table top (or sacrum support) is either secured rigidly to or formed integrally with the first table top (upper body support).

Accordingly, the upper body support and sacrum rest can be moved away from the table base and leg supports, thereby overcoming the problems experienced through use of conventional orthopedic tables discussed above. Since the upper body support can be repositioned relative to the table base, the present invention provides an orthopedic table that can include in a control housing apparatus for controlling the tilt of the upper body support of a design restricted less by size considerations than by functional considerations. Moreover, the present invention provides an orthopedic table which does not force hospital personnel to move the upper body of a patient relative to the upper body support when the upper body must be repositioned horizontally relative to the lower body of the patient.

BRIEF DESCRIPTION OF THE DRAWINGS

The following detailed description of the preferred embodiments can be understood better if reference is made to the attached drawings in which.

DETAILED DESCRIPTION OF THE PREFERRED EMBODIMENTS

Figure 1:
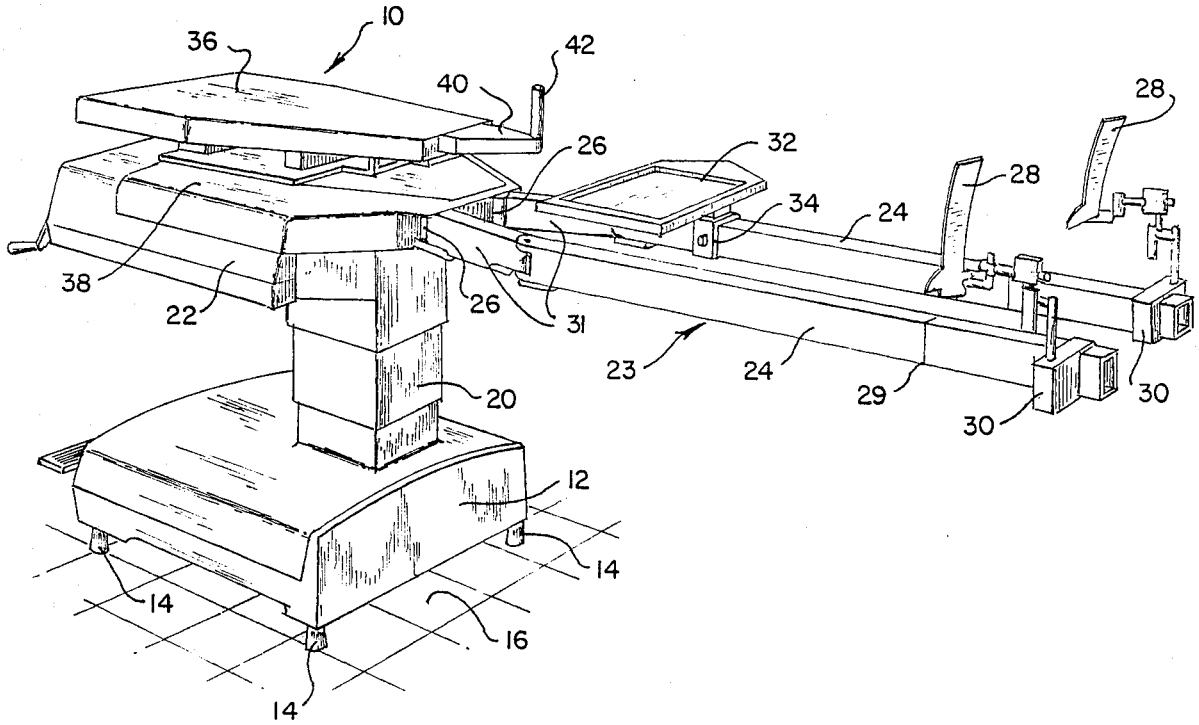
FIG. 1 is an isometric view of an orthopedic surgical table constructed according to the provisions of the present invention.

Referring to the drawings, there is shown an orthopedic table 10 having a conventional base and leg support members. Table 10 includes base member 12 which is supported by four legs 14, one leg 14 disposed at each corner of base member 12, a distance from floor 16. Legs 14 may be of the retractable type which can be withdrawn into base member 12 to permit wheels 18 to contact floor 16 and enable hospital personnel to conveniently reposition table 10 within a room. Column 20 is secured to base member 12 and a control housing 22 in any suitable manner to support control housing 22 a distance from base member 12. Control housing 22, column 20 and base member 12 can include any known control mechanism and operators for tilting control housing 22 to facilitate performance of a variety of orthopedic surgical procedures.

A traction device mounting assembly, generally designated by the reference numeral 23, extends from control housing 22. Assembly 23 includes a pair of abductor bars 24 pivotally secured at 26 to control housing 22 in any suitable known fashion. Abductor bars 24 are capable of horizontal pivotal movement relative to control housing 22 at points 26. Abductor bars 24 include joints 27 to permit members 29 to be pivoted relative to members 31. Abductor bars 24 include foot supports 28 which are releasably and slidably secured to abductor bars 24 with any suitable clamps 30. Foot supports 28 are of any suitable conventional type and are used for the application of traction to a patient in a well-known manner. Each abductor bar 24 can be adapted to receive a conventional X-ray plate, such as X-ray plate 32 shown in FIG. 1, which is clamped to an abductor bar 24 with a suitable clamp 34 which permits sliding movement of X-ray plate 32 along abductor bar 24.

Upper body support 36 is mounted to upper surface 38 of control housing 22 for transverse movement as described more fully below. Sacrum rest 40, including vertical post 42, is rigidly secured to upper body support 36 for movement therewith. Vertical post 42 is adapted to be located in the crotch of a patient positioned on the table during performance of some surgical procedures and maintains the position of the upper body of the patient as traction is pulled on the patient's legs with traction assembly 23. Sacrum rest 40 can be secured to upper body support 36 or can be formed integrally therewith as upper body support 36 is fabricated.

Figure 2:
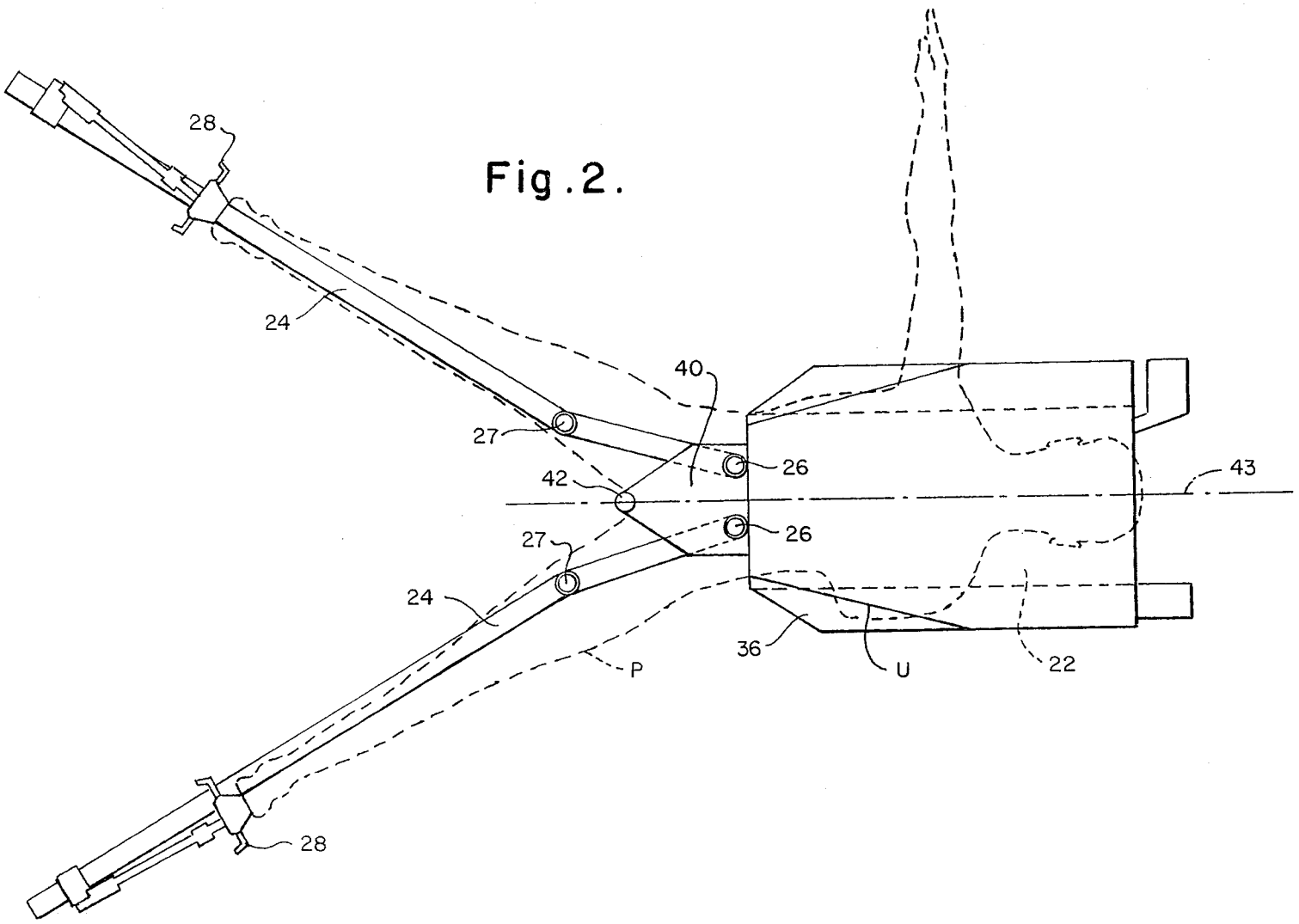
FIG. 2 is a graphic view showing a portion of the table shown in FIG. 1, a patient disposed on the table, and the upper body support in its central position.
Figure 3:
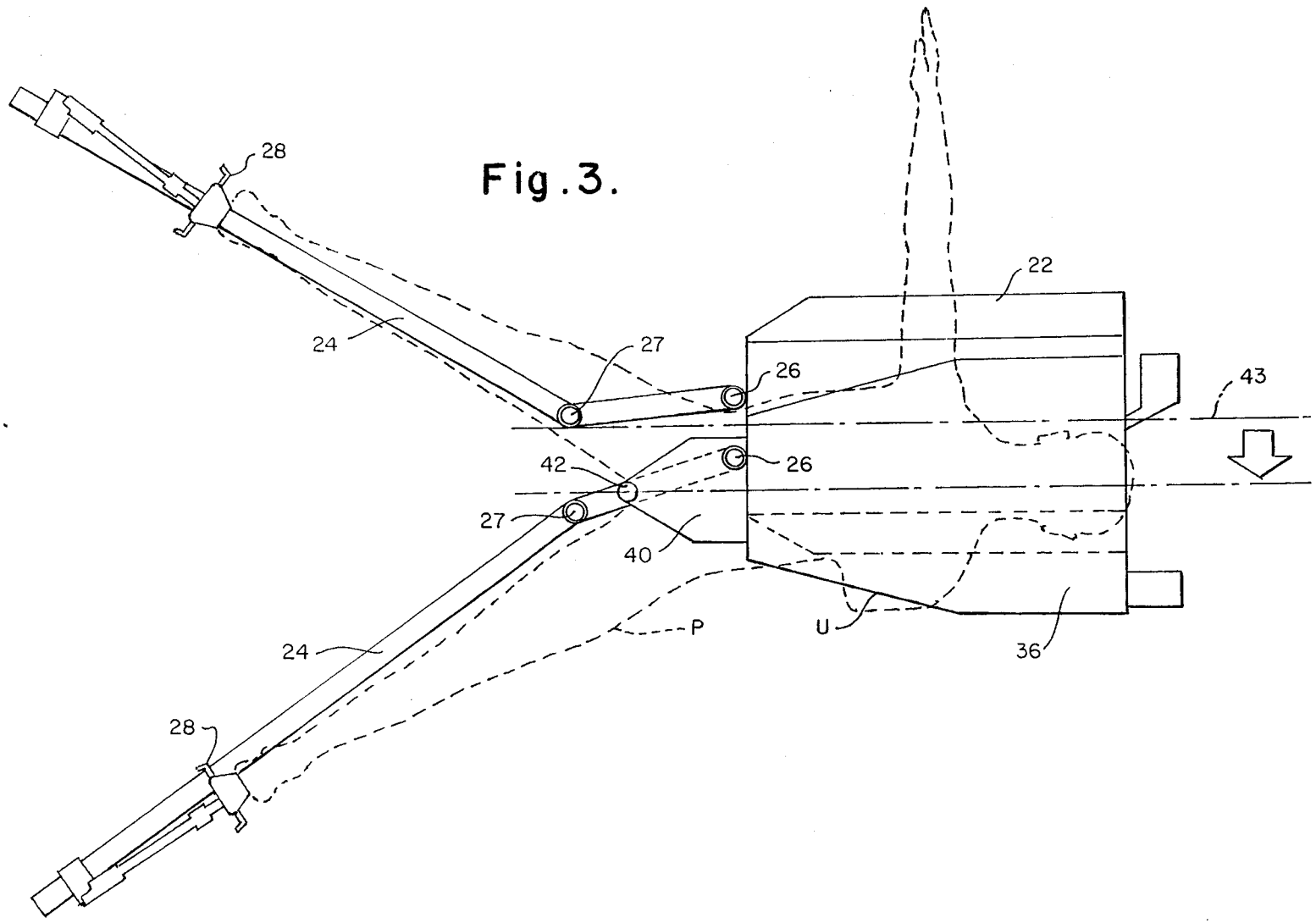
FIG. 3 is a graphic view similar to FIG. 2 but showing the upper body support 36 in one of its off-center positions.
Figure 4:
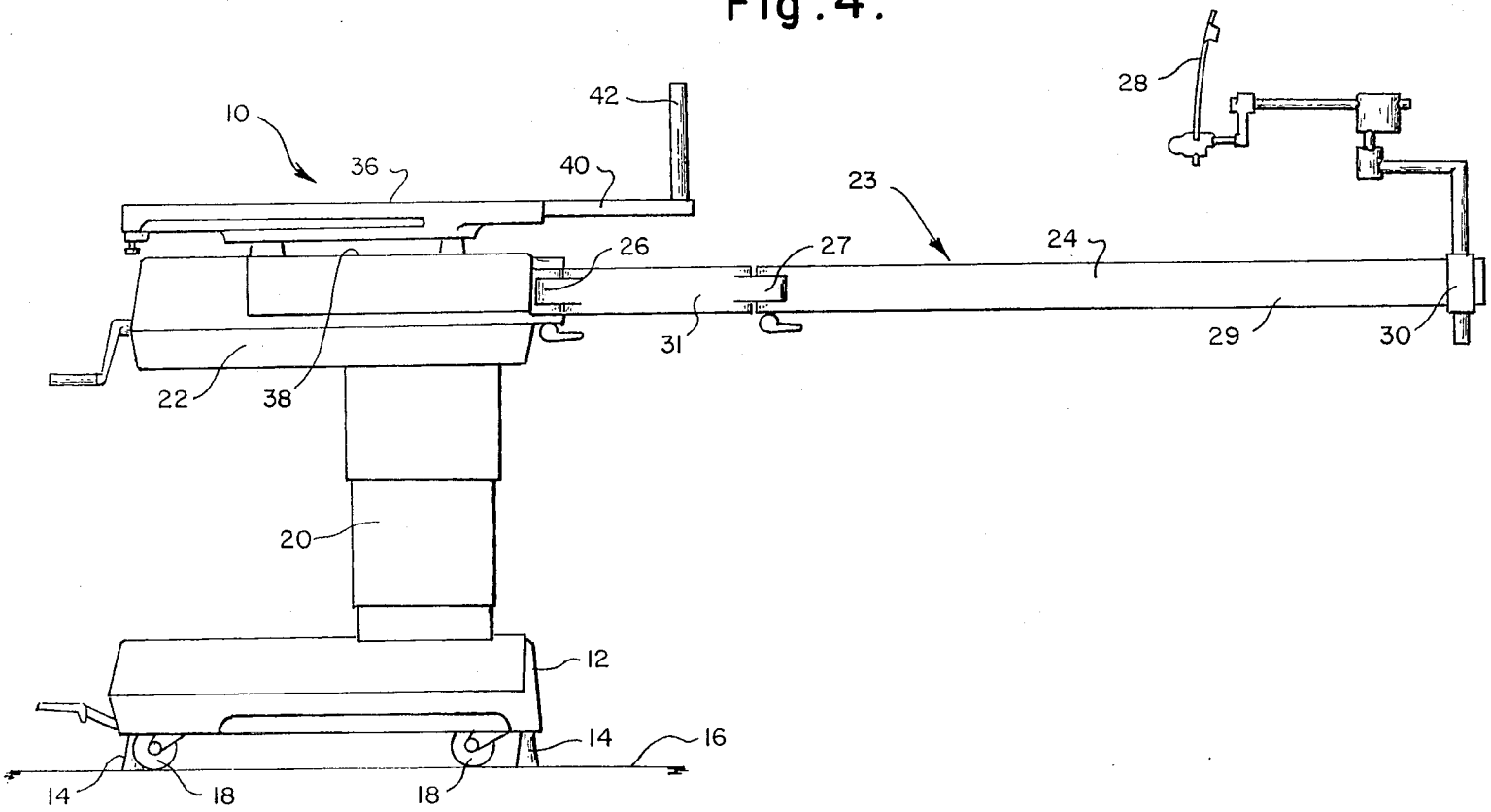
FIG. 4 is a side elevational view of the orthopedic table shown in FIG. 1, but with the X-ray plate removed.

In the preferred embodiment of the present invention, upper body support 36 and sacrum rest 40 are movable together in a direction transverse to the longitudinal axis 43 of orthopedic table 10 as shown in FIGS. 2 and 3. Accordingly, the upper body U of patient P can be repositioned without moving patient P relative to upper body support 36 and upper body U of patient P can be moved away from points of attachment 26 of abductor bars 24 to control housing 22 and away from control housing 22, column 20 and base member 12, thereby providing the benefits more fully described above.

The means for moving upper body support 36 and sacrum rest 40 in unitary fashion to selected points on either side of longitudinal axis 43 may be any one of a variety of well-known means. A particularly advantageous moving mechanism is disclosed in U.S. application Ser. No. 332,655, filed Dec. 21, 1981, which application is owned by the assignee hereof and is incorporated by reference herein.

What is claimed is:

1. An orthopedic table having a longitudinal axis, said table used for supporting a patient during the performance of orthopedic procedures, said table comprising:

a base bisected by a vertical plane within which the longitudinal axis of the table lies;

first table top means mounted on said base for supporting a patient's upper body, said first table top means having a first position wherein a longitudinal axis of said first table top means is colinear with the longitudinal axis of the table;

second table top means mounted adjacent to said first table top means for supporting a patient's sacrum, said second table top means having a first position wherein a longitudinal axis of said second table top means is colinear with the longitudinal axis of the table;

means for moving said first and second table top means in unitary fashion in a direction transverse to the longitudinal axis of said table to selected second positions to enable imaging equipment to be located thereunder; and a traction mounting assembly including abductor bar means for engaging and supporting the patient's lower extremities, said abductor bar means being pivotally mounted to and extending substantially perpendicularly from said base such that upon movement of said first and second table top means to said selected second position said abductor bar means pivot to accommodate the patient's lower extremities.

2. The table recited in claim 1 wherein said first and second table top means are rigidly connected to each other.

* * * * *